US006199597B1

(12) United States Patent
David

(10) Patent No.: US 6,199,597 B1
(45) Date of Patent: Mar. 13, 2001

(54) SEAT BELT WEBBING DOUBLE FACED WITH RIBS

(75) Inventor: Frederick R. David, Warminster, PA (US)

(73) Assignee: Narricot Industries, Inc., Cheltenham, PA (US)

( * ) Notice: Subject to any disclaimer, the term of this patent is extended or adjusted under 35 U.S.C. 154(b) by 0 days.

(21) Appl. No.: 09/170,645

(22) Filed: Oct. 13, 1998

(51) Int. Cl.[7] ..... D03D 1/00; D03D 15/00; B60R 22/12

(52) U.S. Cl. ..... 139/383 R; 139/22; 297/468

(58) Field of Search ..... 139/383 R, 22, 139/432; 29/468

(56) References Cited

U.S. PATENT DOCUMENTS

| | | | | |
|---|---|---|---|---|
| 4,174,738 | | 11/1979 | Berger et al. . | |
| 4,177,839 | * | 12/1979 | Kikuchi | 139/419 |
| 4,313,473 | | 2/1982 | Reiter . | |
| 4,981,161 | * | 1/1991 | Pickering et al. | 139/383 R |
| 5,054,524 | * | 10/1991 | Kato et al. | 139/383 R |
| 5,167,263 | * | 12/1992 | Kelen et al. | 139/383 R |

FOREIGN PATENT DOCUMENTS 9-309405 * 12/1997 (JP) .

* cited by examiner

*Primary Examiner*—Andy Falik
(74) *Attorney, Agent, or Firm*—Akin, Gump, Strauss, Hauer & Feld, L.L.P.

(57) ABSTRACT

A webbing for seat belts having a plurality of warp yarns interwoven with a plurality of weft yarns which are inserted through a shed in the warp yarns is provided. The warp yarns include a first group and a second group, with the second group of warp yarns having a higher density across a portion of the width of the shed than the warp yarns of the first group. At least some of the warp yarns in the second group are separated from one another by the warp yarns of the first group. The webbing has two faces and is flexible from a first, generally flat position to a second, flexed position. When the webbing is in the generally flat position, the first and second groups of warp yarns on one fabric face define a generally smooth surface. When the webbing is in the second, flexed position in which a first portion of the one fabric face is separated from a second portion of the one fabric face by a transition area, and the first portion is positioned generally at an angle $\alpha$ of less than 180° from the second portion of the one fabric face, at least a portion of the second group of warp yarns in the transition area protrude at least partially from the generally smooth surface to define a plurality of ribs.

20 Claims, 2 Drawing Sheets

SEAT BELT WEBBING DOUBLE FACED WITH RIBS

BACKGROUND OF THE INVENTION

Briefly stated, the present invention relates to seat belt webbing, and more particularly to an improved seat belt webbing having low longitudinal stiffness and reduced friction characteristics to assist in retraction and extraction of the seat belt.

Seat belt (also called safety belt) systems have evolved significantly as these systems have become standard equipment in all types of automotive vehicles. Different designs of seat belts have been provided for various types of systems, depending upon the properties desired. It has been recognized that in order to provide an effective seat belt system, it is preferable that the seat belt webbing have various desirable characteristics.

Desirable characteristics of seat belt webbing typically include: good lateral stiffness to help prevent roping or twisting of the seat belt, such as within the "D" ring upon extraction or retraction which could lead to a malfunction of the seat belt system; low longitudinal stiffness to reduce the retraction and extraction of the seat belt into and out of the seat belt winding mechanism; good abrasion resistance to help ensure a long product life; and passenger comfort to promote product use.

Passenger comfort is often associated with reduced spring tension in the winding mechanism. The winding mechanism is used to retract the seat belt when not in use, and typically include a spool upon which the webbing is coiled as well as a spring for applying tension to the seat belt as it is extracted so that it can be automatically retracted when released by the user. The spring tension must be high enough so that the seat belt webbing will be fully retracted with reliability, but the spring tension must not be so great that it causes discomfort to the user as the seat belt is being fastened and worn. A main force resisting retraction of the seat belt webbing is friction generated between the surface of the seat belt webbing and the guide members of the seat belt restraint system through which it passes. All of these traits are now being considered more by purchasers of automobiles when evaluating overall automobile quality, and accordingly, are being carefully evaluated by manufacturers for improvement.

It would be desirable to provide a woven seat belt webbing having all of the desired characteristics as set forth above, as well as a seat belt webbing which permits a winding mechanism with reduced spring tension to be used in order to increase user comfort.

BRIEF SUMMARY OF THE INVENTION

Briefly stated, the present invention is a webbing for seat belts having a plurality of warp yarns interwoven with a plurality of weft yarns which are inserted through a shed in the warp yarns. The warp yarns include a first group and a second group, with the second group of warp yarns having a higher density across a portion of the width of the shed than the warp yarns of the first group. At least some of the warp yarns in the second group are separated from one another by the warp yarns of the first group. The webbing has two faces and is flexible from a first, generally flat position to a second, flexed position. When the webbing is in the generally flat position, the first and second groups of warp yarns on one fabric face define a generally smooth surface. When the webbing is in the second, flexed position, in which a first portion of the one fabric face is separated from a second portion of the one fabric face by a transition area, and the first portion is positioned generally at an angle $\alpha$ of less than 180° from the second portion of the one fabric face, at least a portion of the second group of warp yarns in the transition area protrude at least partially from the generally smooth surface to define a plurality of ribs.

In another aspect, the present invention provides a webbing for seat belts having a plurality of warp yarns interwoven with a plurality of weft yarns. First and second groups of warp yarns are provided. The first group of warp yarns is interwoven with the weft yarns in a first weave pattern and the second group of warp yarns is interwoven with the weft yarns in a second weave pattern. At least some of the warp yarns in the second group are separated from one another by the warp yarns from the first group. The webbing has two faces and is flexible from a first, generally flat position to a second, flexed position. When the webbing is in the generally flat position, the first and second group of warp yarns on one fabric face define a generally smooth surface. When the webbing is in the second, flexed position, in which a first portion of the one fabric face is separated from a second portion of the one fabric face by a transition area, and the first portion is positioned generally at an angle $\alpha$ of less than 180° from the second portion of the one fabric face, at least a portion of the second group of warp yarns in the transition area protrude at least partially from the generally smooth surface to define a plurality of ribs.

In another aspect, the present invention provides a seat belt system for motor vehicles comprising a seat belt webbing having a plurality of warp yarns interwoven with a plurality of weft yarns which are inserted through a shed in the warp yarns. First and second groups of warp yarns are provided. The second group of warp yarns having a higher density across a portion of the width of the shed than the warp yarns of the first group. At least some of the warp yarns in the second group are separated from one another by the warp yarns from the first group. A winding mechanism having a spool is provided and the seat belt webbing is at least partially coiled on the spool. A shoulder harness guide member is provided at a position generally corresponding to a user's shoulder, and a portion of the seat belt webbing passes over the shoulder harness guide member to redirect the seat belt webbing which extends from the winding mechanism. A buckle member is connected to the seat belt webbing. The seat belt webbing has two faces and is flexible from a first, generally flat position to a second, flexed position. When the webbing is in the generally flat position, the first and second groups of warp yarns on one fabric face define a generally smooth surface. When the webbing is in the second, flexed position, in which a first portion of the one fabric face is separated from a second portion of the one fabric face by a transition area located at the shoulder harness guide member, and the first portion is positioned at an angle $\alpha$ of less than 180° from the second portion of the one fabric face, at least a portion of the second group of warp yarns in the transition area protrude at least partially from the generally smooth surface to define a plurality of ribs which contact the shoulder harness guide member to reduce friction.

In another aspect, the present invention provides a method of making a seat belt webbing. The method includes:

(a) providing warp yarns in a shedding arrangement for producing a shed;

(b) varying the density of the warp yarns across a width of the shed, to provide first and second groups of warp yarns, the first group of the warp yarns having a first density in a direction of the width of the shed and the second group of the warp yarns having a second, higher density in the direction of the width of the shed and, at least some of the warp yarns of the second group being separated by the warp yarns of the first group;

(c) weaving weft yarns with the warp yarns across the width of the shed;

(d ) stitching along one edge of the webbing to hold the weft yarns in place along the one edge; and (e) forming elevatable ribs which extend longitudinally along the webbing from the second group of warp yarns which elevate from an inner surface of the webbing as the webbing is folded in a lateral direction.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
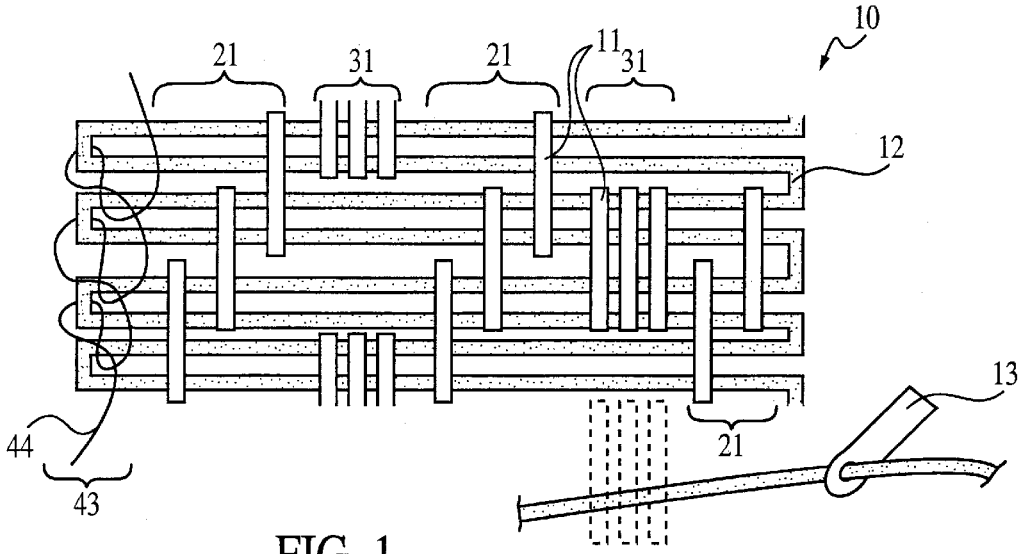
FIG. 1 is a schematic illustration of a top plan view of an exemplary seat belt webbing in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the seat belt webbing 10 in accordance with the present invention and designated parts thereof. The terminology includes the words specifically mentioned above, derivatives thereof and words of similar import.

Referring now to FIG. 1, a schematic illustration of a seat belt webbing 10 in accordance with the present invention is shown as it is being woven in a needle loom. The seat belt webbing 10 includes a plurality of warp yarns 11 which are interwoven with a plurality of weft or filling yarns 12 which are inserted through a shed in the warp yarns 11. While the weft yarns 12 may in fact be a single continuous strand, as used herein and as understood by those of ordinary skill in the art, the term "weft yarn" refers to each pass of the weft yarn across the shed. The seat belt webbing 10 is preferably woven on a conventional needle loom (not shown) which includes a filling insertion arm 13. However, it will be recognized by those skilled in the art from the present disclosure that other types of looms may be utilized, if desired.

In the preferred embodiment of the present invention, the webbing 10 is woven on a needle loom, and it is desirable to provide a knitted edge formation 43 along one edge of the webbing 10. The edge formation 43 provides for an effective and efficient production of the webbing 10, and the edge knitting 43 according to the invention is practiced by knitting either one or more catch cord yarns 44 and/or lock stitch yarns at the edge portion. The tension is controlled on the locking yarns to ensure a uniform edge, such as a Mueller System 3 or a System 5 edge. However, it will be recognized by those skilled in the art from the present disclosure, that depending upon the type of loom utilized, a locking yarn 44 may not be required along one edge of the webbing 10 to hold weft yarns 12 in place.

In a preferred embodiment of the webbing 10, the warp yarns 11 have a density which varies across a width of the shed which corresponds generally to the width of the webbing 10. Specifically, the warp yarns 11 are divided into a first group 21 and a second group 31, with the second group 31 of warp yarns 11 having a higher density across their portion of the width of the shed than the warp yarns 11 of the first group 21. This can be accomplished by various means.

Figure 2:
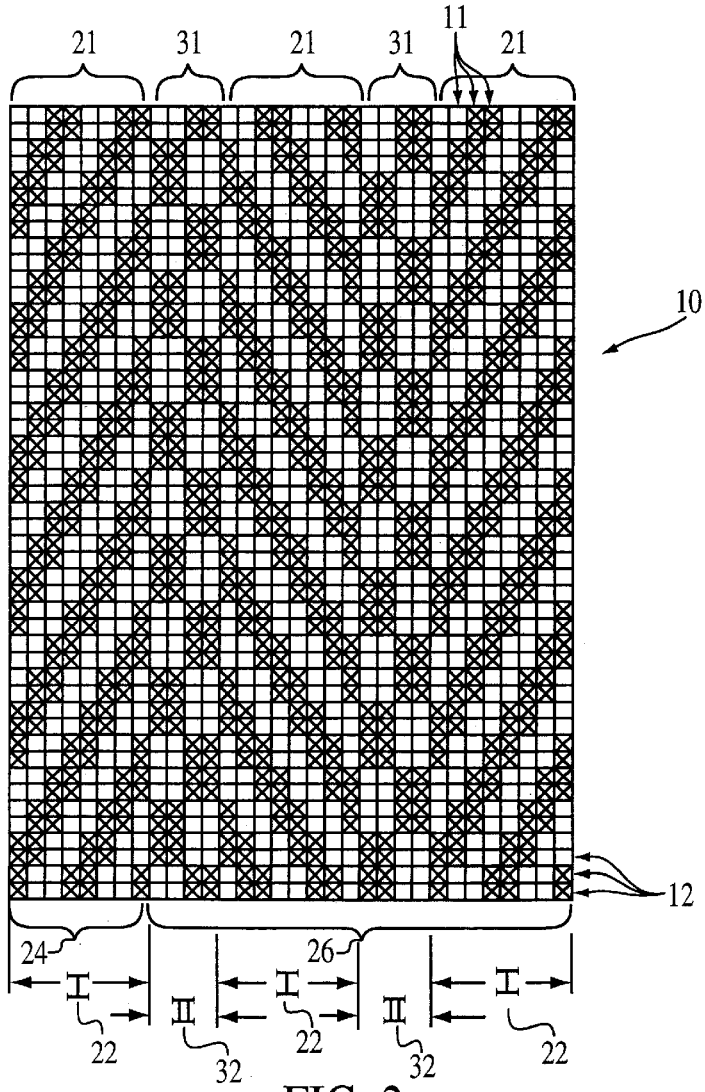
FIG. 2 is a partial weaving chart illustrating a full repeat of a webbing pattern for a preferred embodiment of the seat beat webbing in accordance with the present invention.

In a preferred embodiment of the invention illustrated by the weave chart in FIG. 2, the warp yarns 11 of the first group 21 are woven with the weft yarn 12 in a first weave pattern and the warp yarns 11 of the second group 31 are woven with the weft yarns 12 in a second weave pattern. The weave chart in FIG. 2 represents an edge portion 24 on one side of the webbing 10 and a full repeat 26 which is preferably repeated across the width of the webbing 10 until the opposite edge portion (not shown) is reached. The opposite edge portion is preferably a mirror image of the edge portion 24. As shown in FIG. 2, at least some of the warp yarns 11 in the second group 31 are separated from one another by the warp yarns 11 from the first group 21. In the preferred embodiment, as illustrated in FIG. 2, the first group of warp yarns 21 are woven with the weft yarns 12 in a four harness twill, with two weft yarns being provided in each shed due to the use of a needle loom.

As shown in detail in FIG. 2, in one preferred embodiment, the second group 31 of the warp yarns 11 is divided into a number of equally spaced groupings 32, which are spaced apart by groupings 22 of the warp yarns 11 from the first group 21. Preferably there are at least three equally spaced groupings 32 of warp yarns 11 from the second group, and in the preferred embodiment, there are eleven equally spaced groupings 32. However, it will be recognized by those skilled in the art from the present disclosure that any number of groupings 32 of warp yarns 11 from the second group 31 may be provided, and the spacing between the groupings 32 may be equal or unequal, depending on the particular requirements of a given application. The groupings 32 of the warp yarns 11 from the second group 31 are used to provide ribs 40, as will be described in more detail below in order to provide a seat belt webbing 10 with reduced friction characteristics.

The density of the warp yarns 11 can also be varied by increasing the denier of the warp yarns 11 of the second group 31 relative to the warp yarns 11 of the first group 21. Alternatively, the warp yarns 11 of the second group 31 can be woven in pairs, as shown in FIG. 2, or in even greater numbers, by inserting multiple yarns through a single heddle eye in order to increase the density, while the warp yarns 11 in the first group 21 are preferably woven individually. Additionally, the number of harnesses, the placement of the heddles in each harness, and/or the harness motion can be varied to vary the density of the warp yarns 11 across the width of the shed.

As shown in FIGS. 1 and 2, preferably each grouping 32 of the second group 31 includes at least a single warp yarn 11. More preferably, as shown in FIG. 2, each grouping 32 of warp yarns 11 of the second group 31 includes a pair of adjacent warp yarns 11 which have the same weave in order to provide an increased density. Additionally, in the preferred embodiment, each grouping 32 of warp yarns 11 of the second group 31 include first and second pairs of adjacent warp yarns, with the first and second pairs of adjacent warp yarns 11 being woven on opposite sides of each shed.

As shown in FIG. 1 the weft yarns 12 can be inserted singly, and may be either monofilament or multi-filament yarns. Furthermore, weft yarns 12 may also be inserted in pairs, with one weft yarn being a monofilament and the other being a multi-filament in order to provide increased lateral stiffness for the webbing 10.

Referring again to FIG. 2 in the preferred embodiment, the twill direction of the groupings 22 of warp yarns 11 in the first group 21 alternates on opposite sides of each grouping 32 of warp yarns 11 in the second group 31. However, it will be recognized by those skilled in the art from the present disclosure that any desired weave pattern can be utilized for the warp yarns 11 of the first group 21, such as a 2×2 twill, or any other weave suitable for automotive seat belt webbing.

Figure 3:
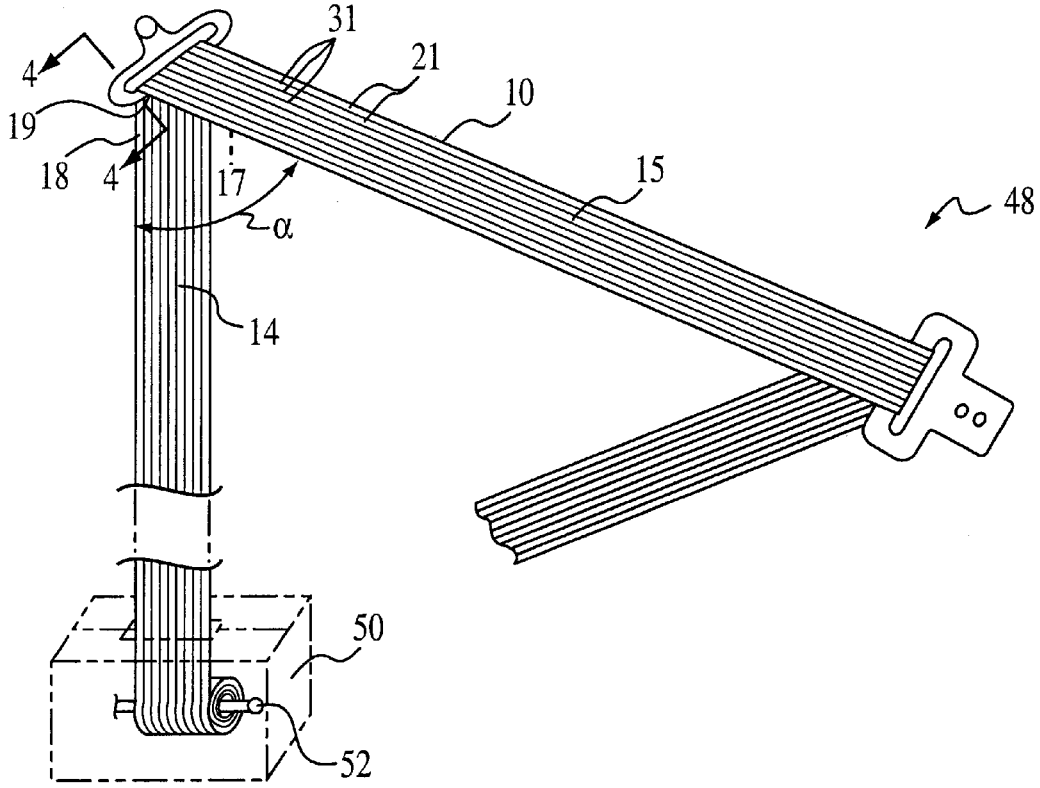
FIG. 3 is an elevational view of a seat belt system using the seat belt webbing in accordance with the present invention.
Figure 4:
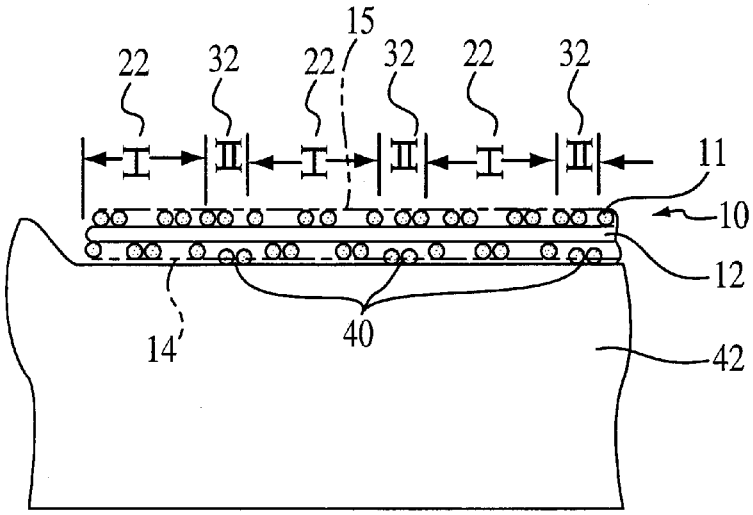
FIG. 4 is a greatly enlarged partial cross-sectional view taken along lines 4—4 in FIG. 3 showing a cross-section of the webbing in a transition area with the ribs being partially extended from the fabric surface.

As shown in FIG. 3, the webbing 10 has two faces 14, 15 and is flexible from a first generally flat position to a second, flexed position. When the webbing is in the generally flat position, the first and second groups 21, 31 of warp yarns 11 define a generally smooth surface. When the webbing is in the second, flexed position, in which a first portion 17 of the one fabric face 14 is separated from a second portion 18 of the one fabric face 14 by a transition area 19, and the first portion 17 is positioned generally at an angle $\alpha$ of less than 180° from the second portion 18 of the first fabric face 14, at least a portion of the second group 31 of warp yarns in the transition area 19 protrude at least partially from the generally smooth surface to define a plurality of ribs 40, as shown in FIG. 4. Preferably, there are at least three equally spaced ribs 40. The ribs 40 are spaced apart at a predetermined distance, which is preferably based upon at least the lateral stiffness of the webbing 10, and preferably the lateral and longitudinal stiffness, such that at least some of the interwoven warp yarns 11 of the first group 21 which are located between adjacent ribs 40 are bridged over a guide member 42 which contacts the ribs 40 protruding from the one face 14 of the webbing 10 in the transition area 19 to reduce friction as the webbing 10 slides over the guide member 42.

In the preferred embodiment, based upon the weave pattern, each rib 40 appears to be continuous in nature due to the adjacent pairs of warp yarns 11 of each grouping 32 being woven on opposite sides of each shed, such that as the webbing 10 is woven, the first and second adjacent pairs of warp yarns 11 in each grouping 32 are forced together and form a nearly continuous rib 40. However, it will be recognized by those skilled in the art from the present disclosure that the ribs 40 may be discontinuous, as illustrated schematically in FIG. 1, and that adjacent ribs 40 may have oppositely spaced weave patterns such that, while each rib 40 is discontinuous, preferably at least a portion of one of the ribs 40 in adjacent pairs of ribs 40 contacts the guide member 42 in the transition area 19 at any given time.

It will recognized by those skilled in the art that the present invention is not limited to any particular weave pattern or any particular types of warp or weft yarns 11, 12. The warp and weft yarns 11, 12 may be either single or multiple ply yarns of any given denier, and may be twisted or untwisted. The deniers of the warp and weft yarns 11, 12 are preferably chosen depending upon the type of yarn used and a particular customer's requirement. Additionally, different types of weft yarns or warp yarns may be used within a single webbing in order to obtain different properties from different yarns. For example, when the weft yarns 12 are inserted in pairs, one yarn may have different properties than the other yarn. It will be similarly recognized that the height, density and thickness of the ribs 40 as well as the locations selected for the ribs 40 may also be varied depending upon a particular customer's requirements and the ribs 40 may be spaced uniformly or non-uniformly, as desired.

Preferably, the warp yarns 11 are single ply polyester yarns having a denier of about 1300. The weft yarn 12 is preferably a multi-filament yarn comprised of polyester and having a denier of about 840. The catch cord 44 is preferably a polyester yarn having an denier of about 500. The webbing 10 preferably is provided with a good lateral stiffness, low longitudinal stiffness, abrasion resistance and enhanced user comfort due to the ribs 40 which protrude in the transition area 19 as the webbing 10 passes over a guide member 42 in a seat belt system. In the preferred embodiment, the webbing 10 is approximately two inches wide. However, the webbing 10 can be used in applications in which the width is preferably between 1.0 and 4.0 inches. It is also possible to make the webbing 10 in other narrower or wider sizes for various other applications. It is also possible to make the webbing with additional features including, but not limited to, standard and high elongations, and various round and other comfort edges.

Referring again to FIG. 3, a seat belt system 48 is shown in detail and includes the seat belt webbing 10 which is provided on a winding mechanism 50 having a spool 52, with the seat belt webbing 10 being at least partially coiled on the spool 52. The shoulder harness guide member 42 is provided at a position generally corresponding to a user's shoulder, and the seat belt webbing 10 passes over the shoulder harness guide member 42 to redirect the seat belt webbing 10 which extends from the winding mechanism 52. A buckle member 54 is connected to the seat belt webbing 10 by passing through an opening in the buckle member 54, and the end of the seat belt webbing is anchored in a fixed position (not shown). However, it will be recognized by those skilled in the art from the present disclosure that the seat belt webbing 10 may be used in other types of retractable seat belt systems. As the seat belt webbing 10 is drawn across the guide member 42, the groupings 32 of warp yarns 11 in the second group 31 protrude from the generally smooth surface on the face 14 of the seat belt webbing 10 facing the guide member 42 to reduce friction.

The webbing 10 is made by providing warp yarns 11 in a shed with the density of the warp yarns 11 being varied across the width of the shed. The first group 21 of the warp yarns 11 has a first density in a direction of the width of the shed and the second group 31 of warp yarns 11 have a second, higher density in the direction of the width of the shed, and at least some of the warp yarns 11 of the second group 31 are separated by warp yarns 11 of the first group 21. Weft yarns 12 are woven with the warp yarns 11 across the width of the shed and are preferably stitched along one edge of the webbing using a catch cord 44. Elevatable ribs 40 which are located longitudinally along the webbing 10 are formed from the second group 31 of warp yarns 11 which elevate from an inside surface 14 of the webbing 10 as the webbing 10 is folded in a longitudinal direction to produce a lateral fold.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A shed for seat belts comprising:

a plurality of warp yarns interwoven with a plurality of weft yarns which are inserted through a shed in the warp yarns, the warp yarns including a first group and a second group, the second group of the warp yarns having a higher density across a portion of a width of the shed than the warp yarns of the first group, at least some of the warp yarns in the second group being separated from one another by the warp yarns from the first group;

the webbing having two faces and being flexible from a first, generally flat position, in which the first and second groups of warp yarns on one fabric face define a generally smooth surface, to a second, flexed position, in which a first portion of the one fabric face is separated from a second portion of the one fabric face by a transition area, the first portion being positioned generally at an angle $\alpha$ of less than 180° from the second portion of the one fabric face, such that at least a portion of the second group of warp yarns in the transition area protrude at least partially from the generally smooth surface to define a plurality of ribs.

2. The webbing for seat belts of claim 1 wherein the second group of the warp yarns is divided into a plurality of groupings.

3. The webbing for seat belts of claim 2 wherein the groupings of the second group of the warp yarns are equally spaced.

4. The webbing for seat belts of claim 2 wherein each of the groupings of the second group includes first and second pairs of adjacent warp yarns, the first and second pairs of adjacent warp yarns are woven on opposite sides for each shed.

5. The webbing for seat belts of claim 2 wherein each grouping of second group includes a pair of adjacent warp yarns which have the same weave.

6. The webbing for seat belts of claim 2 wherein each grouping of second group includes a single warp yarn.

7. The webbing for seat belts of claim 1 wherein the weft yarns are inserted in pairs.

8. The webbing for seat belts of claim 1 wherein the warp yarns of the first group are woven with the weft yarns in a first weave pattern and the warp yarns of the second group are woven with the weft yarns in a second weave pattern.

9. The webbing for seat belts of claim 8, wherein the first group of the warp yarns are woven in a four harness twill.

10. The webbing for seat belts of claim 9 wherein the twill direction alternates between groupings of the warp yarns in the first group of warp yarns which are separated by groupings of the warp yarns in the second group of warp yarns.

11. The webbing for seat belts of claim 1 wherein the webbing is between 1.0 and 4.0 inches wide.

12. The webbing for seat belts of claim 1 wherein there are at least three equally spaced ribs.

13. The webbing for seat belts of claim 1 wherein the ribs are spaced apart at a predetermined distance based on at least a lateral stiffness of the webbing such that at least some of the interwoven warp yarns of the first group which are located between adjacent ribs are adapted to be bridged over a guide member which contacts the ribs protruding from the one face of the webbing in the transition area to reduce friction as the webbing slides over the guide member.

14. The webbing for seat belts of claim 1 wherein each rib is discontinuous.

15. The webbing for seat belts of claim 1 wherein the second group of warp yarns has a different denier than the first group of warp yarns.

16. The webbing for seat belts of claim 1 wherein the warp yarns and the weft yarns are at least one of multifilament yarns, monofilament yarns, and a combination of multifilament and monofilament yarns.

17. The webbing for seat belts of claim 1 wherein the warp yarns in the first group are woven individually and the warp yarns of the second group are woven in pairs.

18. A webbing for seat belts comprising:

a plurality of warp yarns interwoven with a plurality of weft yarns, the warp yarns including a first group of warp yarns and a second group of warp yarns, the first group of warp yarns being interwoven with the weft yarns in a first weave pattern and the second group of warp yarns being interwoven with the weft yarns in a second weave pattern, at least some of the warp yarns in the second group being separated from one another by the warp yarns from the first group;

the webbing having two faces and being flexible from a first, generally flat position, in which the first and second groups of warp yarns on one fabric face define a generally smooth surface, to a second, flexed position in which a first portion of the one fabric face is separated from a second portion of the one fabric face by a transition area, the first portion being positioned generally at an angle $\alpha$ of less than 180° from the second portion of the one fabric face, such that at least a portion of the second group of warp yarns in the transition area protrude at least partially from the generally smooth surface to define a plurality of ribs.

19. The webbing for seat belts of claim 18 wherein the warp yarns are spaced such that a warp yarn density across the fabric width varies, with the second group of warp yarns has an increased density in comparison to the first group of warp yarns.

20. A method of making a seat belt webbing, comprising:

(a) providing warp yarns in a shed, (b) varying the density of the warp yarns across a width of the shed, a first group of the warp yarns having a first density in a direction of the width of the shed and a second group of the warp yarns having a second, higher density in the direction of the width of the shed, at least some of the warp yarns of the second group being separated by warp yarns of the first group;

(c) weaving weft yarns with the warp yarns across the width of the shed;

(d) stitching along one edge of the webbing to hold the weft yarns in place along the one edge;

(e) forming elavatable ribs which extend longitudinally along the webbing from the second group of warp yarns which elevate from an inner surface of the webbing as the webbing is folded in a longitudinal direction to produce a lateral fold.

* * * * *

UNITED STATES PATENT AND TRADEMARK OFFICE

CERTIFICATE OF CORRECTION

PATENT NO. : 6,199,597 B1
DATED : March 13, 2001
INVENTOR(S) : Frederick R. David It is certified that error appears in the above-identified patent and that said Letters Patent is hereby corrected as shown below:

Column 7,
Line 9, please replace “shed” with -- webbing --;
Lines 15 and 41, please insert “webbing” before -- shed --;
Line 48, please replace “inserted” with -- woven --.

Signed and Sealed this

Sixth Day of August, 2002

*Attest:*

*Attesting Officer*

JAMES E. ROGAN
*Director of the United States Patent and Trademark Office*